US009982957B2

(12) United States Patent
Popikov et al.

(10) Patent No.: US 9,982,957 B2
(45) Date of Patent: May 29, 2018

(54) HINGED-BREECH WEAPON

(71) Applicant: L & O Hunting Group GmbH, Isny (DE)

(72) Inventors: Sergej Popikov, Weitnau (DE); Richard Schmid, Obergünzburg (DE)

(73) Assignee: L & O HUNTING GROUP GMBH, Isny (DE)

( * ) Notice: Subject to any disclaimer, the term of this patent is extended or adjusted under 35 U.S.C. 154(b) by 0 days. days.

(21) Appl. No.: 15/427,239

(22) Filed: Feb. 8, 2017

(65) Prior Publication Data

US 2017/0234633 A1 Aug. 17, 2017

(30) Foreign Application Priority Data

Feb. 11, 2016 (DE) ..... 10 2016 102 403

(51) Int. Cl.
*F41A 3/58* (2006.01)
*F41C 7/11* (2006.01)

(52) U.S. Cl.
CPC . *F41A 3/58* (2013.01); *F41C 7/11* (2013.01)

(58) Field of Classification Search
CPC ..... F41A 3/58; F41C 7/11
See application file for complete search history.

(56) References Cited

U.S. PATENT DOCUMENTS 1,029,374 A * 6/1912 Kremer et al. ..... F41C 7/11 42/75.04
1,797,320 A * 3/1931 Burton ..... F41A 3/58 42/44
4,964,232 A * 10/1990 Mainland ..... F41A 3/58 42/44
5,933,998 A * 8/1999 Plebani ..... F41C 7/11 42/44
6,820,361 B2 11/2004 Popikow
7,313,882 B2 * 1/2008 Beretta ..... F41C 7/11 42/40
2004/0144008 A1 7/2004 Popikow
2015/0184957 A1 * 7/2015 Guerini ..... F41A 3/06 42/40

FOREIGN PATENT DOCUMENTS

DE 4422895 C1 * 10/1995 ..... F41A 21/48
DE 19909114 C1 10/2000
DE 10235283 C1 12/2003
EP 2083237 A2 * 7/2009 ..... F41A 21/08

* cited by examiner

*Primary Examiner* — Stephen Johnson
*Assistant Examiner* — Joshua T Semick
(74) *Attorney, Agent, or Firm* — Paul D. Bianco; Gary S. Winer; Fleit Gibbons Gutman Bongini & Biano PL

(57) ABSTRACT

A hinged-breech weapon includes a receiver, a barrel part arranged to be tiltable around a rotational axis on the receiver, a front shaft removably fastened on the barrel part, and a bearing piece arranged on the rear end of the front shaft, when viewed in the firing direction of the hinged-breech weapon. The bearing piece includes rear bearing surfaces for pivotable mounting on the front mating surfaces of the receiver and a positioning device for adjustment of the position of the bearing piece relative to barrel part. The positioning device includes a clamping element movable in the bearing piece in the longitudinal direction of front shaft and adjustable by a control element for mounting on a stop arranged on the barrel part.

16 Claims, 3 Drawing Sheets

HINGED-BREECH WEAPON

FIELD OF THE INVENTION

The invention concerns a hinged-breech weapon.

BACKGROUND

Such a hinged-breech weapon is known from DE 102 35 283 C1. It has a receiver or breech housing, a barrel part arranged to be tiltable around an axis of rotation on the receiver, a front shaft removably fastened on the barrel part, and a bearing piece arranged on the rear end of the front shaft, when viewed in the firing direction of the hinged-breech weapon, for pivotable support on the receiver. For tiltable mounting of the barrel part on the receiver in this known hinged-breech weapon, inwardly protruding hinge pins are provided on the receiver, which engage in side recesses on a hook element of the barrel and stop against semicircular rear contact surfaces of the side recesses. The bearing piece arranged on the rear end of the front shaft has rear support surfaces for pivotable mounting on matching front surfaces of the receiver. Inwardly protruding pins with at least one lateral mounting surface for mounting on corresponding abutment surfaces of the hook piece are also provided on the bearing piece. By appropriate selection of the simply replaceable pins, the position of the bearing piece relative to the hook piece can be changed and, therefore, the clamping pressure between the hinge pins and the rear mounting surfaces on the hook piece, on the one hand, and the clamping pressure between the rear support surfaces on the bearing part and the corresponding mating surfaces on the receiver, on the other hand, can be adjusted and, therefore, so can the hinge connection between the receiver and the tiltable barrel part. However, the replaceable pins with lateral mounting surfaces and the corresponding abutment surfaces on the hook piece must be precisely manufactured and machined, if necessary.

A hinged-breech weapon containing a barrel hook piece arranged to be tiltable around a rotational bearing on the receiver and a removable front shaft is also known from DE 199 09 114 C1. The front shaft in the area of a rear end has a bearing shell half open to the rear, which, together with a bearing shell half, open to the front arranged on the barrel hook piece, including a hinge pin forming the rotational joint on the receiver. The barrel hook piece contains a downwardly pointing additional tab, which forms an abutment for a stop on the front shaft part. An adapter sleeve is arranged on the front shaft, which is supported on an oblique abutment surface of the tab in the assembled state of the hinged-breech weapon and ensures clamping pressure of the two bearing shell halves against the hinge pins. The hinge connection here, however, is not easily adjustable.

SUMMARY

At least some of the embodiments disclosed relate to a hinged-breech weapon, which permits simple and precise adjustment of the hinge connection between the receiver and the tiltable barrel part.

Expedient embodiments and advantageous modifications of the invention are also disclosed.

The hinged-breech weapon according to the invention contains a receiver, a barrel part arranged to be tiltable around an axis of rotation on the receiver, a front shaft removably fastened to the barrel part and a bearing piece arranged on the rear end of the front shaft, when viewed in the firing direction of the hinged-breech weapon, which contains rear support surfaces for pivotable mounting on the front mating surfaces of the receiver. To adjust the position of the bearing piece relative to the barrel part, the bearing piece contains a positioning device, which includes a clamping element guided to move in the bearing piece in the longitudinal direction of the front shaft and adjustable by a control element for support against a stop arranged on the barrel part. The hinge connection between the receiver and the tiltable barrel part can be simply set and readjusted as required by the clamping element adjustable in the longitudinal direction of the front shaft.

The clamping element, in an expedient embodiment, can be guided to move in an upward and frontward open mounting slot of a frontward protruding shoulder of the bearing piece.

According to another advantageous embodiment, the receiving slot has a slightly greater width than the clamping element so that the clamping element cannot only be pushed within the receiving slot in the direction of a longitudinal axis of the receiving slot running in the longitudinal direction of the front shaft, but also easily rotated around an axis perpendicular to this longitudinal axis. A front mounting surface of the clamping element can, therefore, be easily set oblique and adjusted to the mounting surface of the corresponding stop without demanding manual adjustment.

The receiving slot can expediently be in the form of a T-slot with a narrower outer part facing the barrel and a widened inner part. The corresponding clamping element has the shape of a T-slot nut with a narrower upper part and a wider lower part.

In another advantageous embodiment, the clamping element has a continuous threaded hole with a threaded pin arranged in it. By tightening the threaded pin, the clamping element can be tightened against the bearing part and secured in a set position by so doing.

In a particularly compact and space-saving design, the control element can also be arranged in the receiving slot for the clamping element. The control element can be designed as a control eccentric with a cylindrical part rotatable in the narrower outer part of the receiving slot and an eccentric part arranged in the widened inner part of the receiving slot.

The control element can also have a continuously threaded hole with a threaded pin arranged in it for protection against twisting. The center axis of the threaded hole is expediently offset laterally relative to the center axis of the receiving slot. Undesired adjustment can be avoided particularly well on this account.

BRIEF DESCRIPTION OF THE DRAWINGS

Additional details and advantages of the invention are apparent from the following description of a preferred practical example with reference to the drawings. In the drawings.

DETAILED DESCRIPTION

Figure 1:
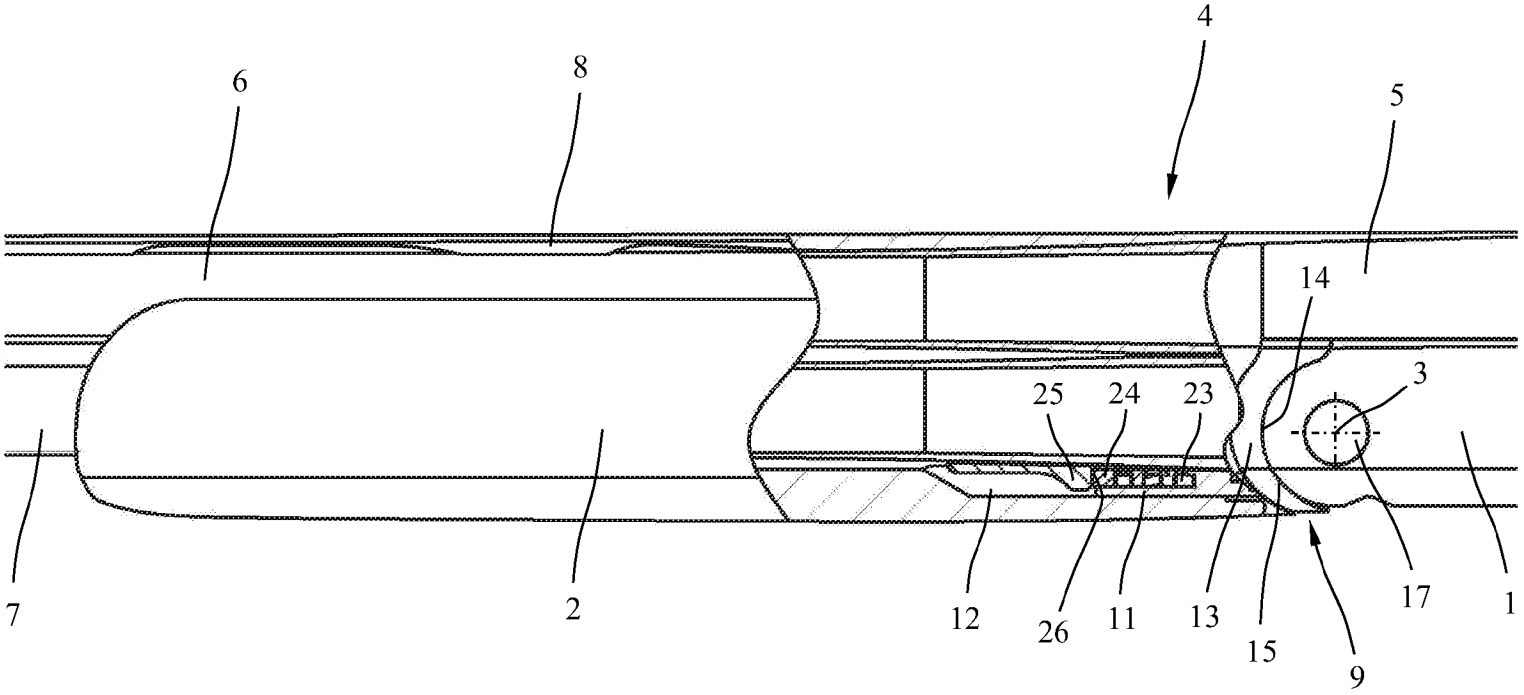
FIG. 1 shows part of a double-barreled hinged-breech weapon with a receiver, a barrel part and a front shaft in a partially cut-away side view.
Figure 2:
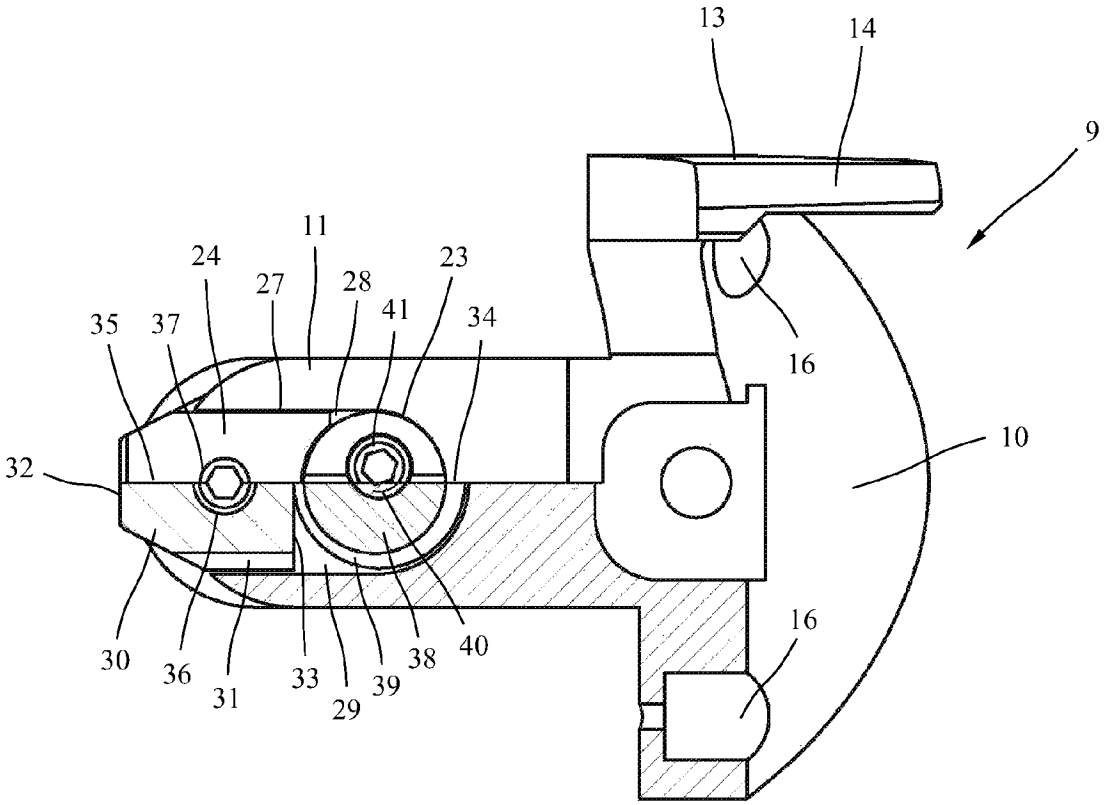
FIG. 2 shows a top view of a bearing part of the front shaft depicted in FIG. 1 in a half-section; and, FIG. 3 shows a hook piece of the hinged-breech weapon of FIG. 1 in a side view.
Figure 3:
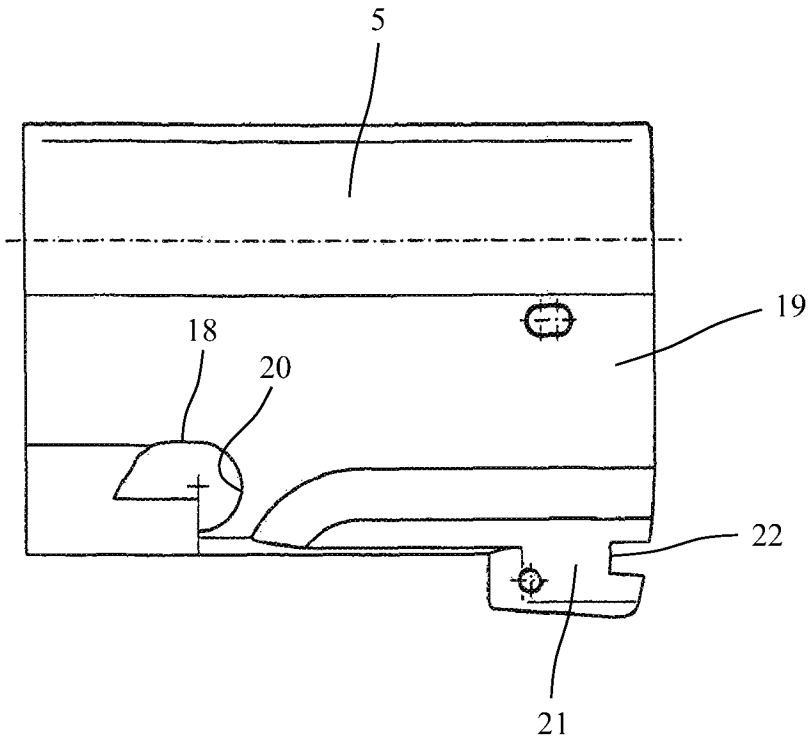

The hinged-breech weapon depicted partly in FIG. 1 contains an only partially shown receiver or breech housing 1, a front shaft 2 and a barrel part 4 arranged to be tiltable and removable around a transverse axis 3 on receiver 1, which in the depicted variant includes a hook piece 5 depicted separately in FIG. 3, two barrels 6 and 7 arranged one above the other and a sighting bar 8. The front shaft 2 has a locking mechanism, not apparent here, on a front end when viewed in the firing direction, for releasable mounting of the front shaft 2 on the lower barrel 7 of the barrel part 4 and a bearing piece 9, depicted separately in FIG. 2, on a rear end for mounting on receiver 1. A rear shaft, not shown here, is fastened in known fashion on the rear end of the receiver 1.

The bearing piece 9, depicted in a half-section top view in FIG. 2 and consisting of metal, contains a rear mounting part 10 and a forward protruding shoulder 11, which is arranged in a recess 12 depicted in FIG. 1 on the rear end of front shaft 2. The U-shaped rear mounting part 10 in a rear view has two side connectors 13 enclosing the hook piece 5, which have, on the rear sides, concave rear support surfaces 14 for mounting on corresponding convex mating surfaces 15 (shown in FIG. 1) on the front end of receiver 1. Two end holes 16 are provided in the mounting part 10 for fastening the bearing piece 9 to front shaft 2.

For tiltable arrangement of the barrel part 4 on the receiver 1 around rotational axis 3, inwardly protruding hinge pins 17 are arranged on two opposite flanks of the receiver 1 depicted in FIG. 1, which engage in lateral recesses 18 on the two side surfaces 19 of the hook piece 5 depicted in FIG. 3. The two frontwardly open lateral recesses 18 each have a semicircular rear mounting surface 20, against which the hinge pins 17, protruding inward from receiver 1, stop. The two semicircular mounting surfaces 20, therefore, form a frontwardly open support surface for tilting movement of the hook piece 5. The hook piece 5 contains a barrel hook 21 on a bottom, which engages a corresponding mounting opening of the receiver 1 and can be locked by a locking wedge engaging a locking slit 22 on the back of barrel hook 21, or released for tilting out of barrel part 4.

Hook piece 5 is forced against the hinge pins 17 via the bearing piece 9 fastened on the rear end of front shaft 2, which, according to FIG. 1, is supported, on the one hand, via a clamping element 24, adjustable by means of a control element 23, on a stop 25 on the lower barrel of barrel part 4 and, on the other hand, presses against the convex mating surfaces 15 on the two side surfaces of the receiver 1 with the concave bearing surfaces 14 on side connectors 13. The hook piece 5 is, therefore, pulled forward under bias relative to the receiver 1 via the bearing piece 9 arranged on the end of the front shaft 2 so that the semicircular rear mounting surfaces 20 on hook piece 5 are supported against the hinge pins 17 of the receiver 1 under tensile stress. In the depicted variant, the stop 25 provided with a rear stop surface 26 is designed as a separate component, which is fastened, for example, by soldering to the lower barrel 7. However, the stop 25 can also be integrated in the barrel or designed in one piece with the barrel.

As follows from FIG. 2, the clamping element 24 is guided to move in a mounting slot 27 of bearing part 9 in the longitudinal direction of front shaft 2. The upward and frontward open mounting slot 27 is situated in the forward protruding shoulder 11 of bearing part 9 and is designed in the form of a T-slot with a narrower outer part 28 facing barrel part 4 and a widened inner part 29. The clamping element 24 is designed in the form of a T-slot nut with a narrower upper part 30 and a wider lower part 31. It has a front mounting surface 32 for mounting on the stop surface 26 of stop 25, as well as a rear mounting surface 33 for control element 23.

The mounting slot 27 has a slightly greater width than the clamping element 24 so that the clamping element 24 within mounting slot 27 cannot only be pushed in the direction of a longitudinal axis 34 of mounting slot 27 running in the longitudinal direction of front shaft 2, but also easily rotated to the side around an axis perpendicular to the longitudinal axis 34. The clamping element 24 can be arranged so that longitudinal axis 35 assumes an angle relative to the center axis 34 of recess 27. The front mounting surface 32 can, therefore, be easily obliquely set and adjusted to the stop surface 26 of stop 25 without demanding manual adjustment. A threaded pin 37 is arranged in a continuous threaded hole 36 of clamping element 24, through which the clamping element 24 can be tightened against the bearing part 9. A previously adjusted position of the clamping element 24 can be secured on this account.

The control element 23 for adjustment of the clamping element 24 is designed in the depicted variant as a control eccentric with a cylindrical part 38 guided to rotate in the narrower outer part 28 of the mounting slot 27 and an eccentric part 39 arranged in the widened inner part 29 of the mounting slot 27. By rotation of the cylindrical part 38 of control element 23 concentric to the center axis 34 of the recess, the clamping element 24 can be pushed over the eccentric part 39 of control element 23. A threaded pin 41 arranged in a threaded hole 40 is also provided in the control element 23 to protect against twisting. The center axis of the threaded hole 40 is offset laterally relative to the center axis 34 of the mounting slot 27.

By adjustment of the clamping element 24, the position of the bearing part 9 arranged on the back side of the front shaft 2 can be changed relative to the barrel part 4 or hook piece 5 and the clamping pressure between the hinge pins 7 and the rear mounting surfaces 20 on the hook piece 5 can be adjusted, on the one hand, as well as the clamping pressure between the concave bearing surfaces 14 on the bearing part 9 and the corresponding mating surfaces 15 on the receiver 1, on the other. In this way, the hinge connection between the receiver 1 and the tiltable barrel part 4 can be simply and precisely adjusted.

During assembly of the hinged-breech weapon just described, the hook piece 5 with the two barrels 6 and 7 and the sighting bar 8 is initially inserted on the receiver 1 so that the hook piece 5 comes in contact from the rear against the two hinge pins 17 with the two mounting surfaces 20. The still downwardly tilting front shaft 2 on the front side can then be positioned with rear bearing piece 9 against the receiver 1 so that the rear bearing surfaces 14 provided on the side connectors 13 of the bearing piece 9 come in contact with the corresponding mating surfaces 15 of the receiver 1. The front shaft 2 can also be pivoted upwardly on the front side so that the clamping element 24 comes in contact with stop 25 and the front shaft 2 is locked on the front side by the locking mechanism on the lower barrel part 7, not depicted here. By a corresponding rotation of the control element 23, the clamping pressure of the bearing part 9 against the receiver 1 can be changed and the hinge connection adjusted in so doing. When optimal adjustment of the clamping element 24 is found, the two threaded screws can be tightened so that the desired position of the clamping element 24 is secured and undesired rotation of the control element 23 can be avoided. For disassembly of the barrel part 4 only the locking mechanism on the front side of the front shaft need be loosened so that the front shaft 2 can be pivoted downwardly and removed. The barrel part 4 can then also be unhooked.

What is claimed is:

1. A hinged-breech weapon comprising:

a receiver, a barrel part arranged to be tiltable around a rotational axis on the receiver, a front shaft removably fastened on the barrel part, and a bearing piece arranged on a rear end of the front shaft with respect to a firing direction of the hinged-breech weapon, the bearing piece including rear bearing surfaces for pivotable mounting on front mating surfaces of the receiver and a positioning device for adjustment of a position of the bearing piece relative to the barrel part, wherein the positioning device includes a clamping element guided to move in the bearing piece in a longitudinal direction of the front shaft and adjustable through a control element for mounting on a stop arranged on the barrel part, wherein the clamping element is guided to move in an upwardly and frontwardly open mounting slot of a forward protruding shoulder of the bearing piece, wherein the upwardly and frontwardly open mounting slot has a form of a T-slot with a narrower outer part facing the barrel part and a widened inner part, and the clamping element has a form of a T-slot nut with a narrow upper part and a wider lower part, and wherein the control element is a control eccentric with a cylindrical part guided to rotate in the narrower outer part of the upwardly and frontwardly open mounting slot and an eccentric part arranged in the widened inner part of the upwardly and frontwardly open mounting slot.

2. The hinged-breech weapon of claim 1, wherein the upwardly and frontwardly open mounting slot has a slightly greater width than the clamping element guided therein.

3. The hinged-breech weapon of claim 1, wherein the clamping element contains a front mounting surface for mounting on a rear stop surface of the stop.

4. The hinged-breech weapon of claim 1, wherein the clamping element has a continuously threaded hole with a threaded pin arranged therein.

5. The hinged-breech weapon of claim 1, wherein the control element is arranged in the upwardly and frontwardly open mounting slot for the clamping element.

6. The hinged-breech weapon of claim 1, wherein the control element contains a continuously threaded hole with a threaded pin arranged therein.

7. The hinged-breech weapon of claim 1, wherein the receiver has inwardly protruding hinge pins for engagement in lateral recesses on a hook piece of the barrel part.

8. The hinged-breech weapon of claim 7, wherein the lateral recesses have rear mounting surfaces for the inwardly protruding hinge pins.

9. A hinged-breech weapon comprising:

a receiver, a barrel part arranged to be tiltable around a rotational axis on the receiver, a front shaft removably fastened on the barrel part, and a bearing piece arranged on a rear end of the front shaft with respect to a firing direction of the hinged-breech weapon, the bearing piece including rear bearing surfaces for pivotable mounting on front mating surfaces of the receiver and a positioning device for adjustment of a position of the bearing piece relative to the barrel part, wherein the positioning device includes a clamping element guided to move in the bearing piece in a longitudinal direction of the front shaft and adjustable through a control element for mounting on a stop arranged on the barrel part, wherein the clamping element is guided to move in an upwardly and frontwardly open mounting slot of a forward protruding shoulder of the bearing piece, wherein the control element contains a continuously threaded hole with a threaded pin arranged therein, and wherein a center axis of the continuously threaded hole in the control element is laterally offset relative to a center axis of the upwardly and frontwardly open mounting slot.

10. The hinged-breech weapon of claim 9, wherein the upwardly and frontwardly open mounting slot has a form of a T-slot with a narrower outer part facing the barrel part and a widened inner part, and the clamping element has a form of a T-slot nut with a narrow upper part and a wider lower part.

11. The hinged-breech weapon of claim 9, wherein the receiver has inwardly protruding hinge pins for engagement in lateral recesses on a hook piece of the barrel part.

12. The hinged-breech weapon of claim 11, wherein the lateral recesses have rear mounting surfaces for the inwardly protruding hinge pins.

13. The hinged-breech weapon of claim 9, wherein the upwardly and frontwardly open mounting slot has a slightly greater width than the clamping element guided therein.

14. The hinged-breech weapon of claim 9, wherein the clamping element contains a front mounting surface for mounting on a rear stop surface of the stop.

15. The hinged-breech weapon of claim 9, wherein the clamping element has a continuously threaded hole with a threaded pin arranged therein.

16. The hinged-breech weapon of claim 9, wherein the control element is arranged in the upwardly and frontwardly open mounting slot for the clamping element.

* * * * *